US011183778B2

(12) United States Patent
Juillet et al.

(10) Patent No.: US 11,183,778 B2
(45) Date of Patent: Nov. 23, 2021

(54) WEDGE CONNECTOR INTERFACE HOLDING DEVICE

(71) Applicant: Richards Manufacturing Company, LP, Irvington, NJ (US)

(72) Inventors: Christopher Juillet, Warren, NJ (US); Richard Fox, Branchburg, NJ (US); Joseph Bier, Warren, NJ (US)

(73) Assignee: Richards Mfg. Co., Irvington, NJ (US)

( * ) Notice: Subject to any disclaimer, the term of this patent is extended or adjusted under 35 U.S.C. 154(b) by 15 days.

(21) Appl. No.: 16/745,791

(22) Filed: Jan. 17, 2020

(65) Prior Publication Data

US 2020/0235500 A1 Jul. 23, 2020

Related U.S. Application Data

(60) Provisional application No. 62/800,342, filed on Feb. 1, 2019, provisional application No. 62/794,473, filed on Jan. 18, 2019.

(51) Int. Cl.
*H01R 4/50* (2006.01)
*H01R 4/38* (2006.01)

(52) U.S. Cl.
CPC ..... *H01R 4/5091* (2013.01); *H01R 4/38* (2013.01)

(58) Field of Classification Search
CPC ..... H01R 4/5083; H01R 4/38; H01R 4/42; F16B 15/00; F16L 3/13
See application file for complete search history.

(56) References Cited

U.S. PATENT DOCUMENTS 5,340,335 A * 8/1994 Haun ..... H01R 4/5091 439/783
5,815,894 A * 10/1998 Soriano ..... A01K 97/08 24/510
8,439,316 B2 * 5/2013 Feige ..... F16L 3/10 248/71
2018/0331435 A1 * 11/2018 Murugiah ..... H01R 4/5083

* cited by examiner

*Primary Examiner* — Briggitte R. Hammond
(74) *Attorney, Agent, or Firm* — Bakos & Kritzer

(57) ABSTRACT

An apparatus and methods of securing a C-Frame to a cable run during the installation process of a cable tap are disclosed. A holding device is removably coupled to an interface positioned adjacent to a C-Frame loosely coupled to a cable run. The holding device which is coupled to the interface is slid over and onto the C-Frame, thereby securing the C-Frame to the cable run. Thereafter, a cable tap is coupled to the C-Frame.

17 Claims, 12 Drawing Sheets

WEDGE CONNECTOR INTERFACE HOLDING DEVICE

CROSS-REFERENCE TO RELATED APPLICATION

This application claims the benefit of U.S. Patent App. No. 62/800,342, filed on Feb. 1, 2019, and the foregoing application is incorporated by reference herein in its entirety.

TECHNICAL FIELD

The apparatus and methods disclosed herein relate to an assembly for connecting electrical connections.

BACKGROUND

Wedge connectors are commonly used in overhead electrical applications for connecting a cable tap off a main cable run. Wedge connectors are made in a variety of designs. One widely used design has a screw-driven wedge inside a C-Frame to tighten two cables with an interface between them. Since several loose pieces need to be held together while the screw is tightened, it is difficult to assemble the known wedge connectors on an overhead line by a field operator. This difficulty is compounded by the need for a field operator to wear insulated gloves during installation.

SUMMARY

The principles disclosed herein provide for a holding device and methods for securing a C-Frame to a cable run during the installation process of a cable tap to a cable run. The principles disclosed herein are designed to overcome the physical and electrical limitations imposed by traditional compression or bolted connectors existing in the art. A reliable, durable, and dependable assembly connector is presented herein that is designed to reduce life cycle and maintenance costs in multiple ways while maximizing contact with low resistance between power connectors and conductors and reducing problems associated with the oxidation of metallic surfaces, including in environments that may be salt-laden. The present connector is designed to be removable and reusable and capable of compensating for thermal fluctuations while maintaining secure constant connection force. To install the connector, a holding device is removably coupled to an interface adjacent to a C-Frame, which is initially loosely coupled to a cable run. Thereafter, the holding device which is coupled to the interface is slid over and onto the C-Frame, thereby securing the C-Frame to the cable run. After this procedure is complete, the C-Frame is configured to hang on the cable run with the interface in place without requiring a field operator to hold any components. At that point, the field operator's hands are free to install a cable tap and tighten the screw to engage a wedge and complete coupling the cable tap to the cable run. The coupled line is secured with the use of minimal tools in the field such as those commonly used by field operators. In addition, the secured connection will be permanently coupled (but removably locked for maintenance) through fault current or power surges.

In accordance with the principles disclosed herein, the holding device can be composed of any material that can withstand the temperatures of the electrical connection. As a result, the holding device can be left in place after installation or removed.

BRIEF DESCRIPTION OF THE DRAWINGS

The detailed description makes reference to the accompanying figures wherein.

The figures are only intended to facilitate the description of the principles disclosed herein. The figures do not illustrate every aspect of the principles disclosed herein and do not limit the scope of the principles disclosed herein. Other objects, features, and characteristics will become more apparent upon consideration of the following detailed description.

DETAILED DESCRIPTION

A detailed illustration is disclosed herein. However, techniques, methods, processes, systems, and operating structures in accordance with the principles disclosed herein may be embodied in a wide variety of forms and modes, some of which may be quite different from those disclosed herein. Consequently, the specific structural and functional details disclosed herein are merely representative.

Figure 1:
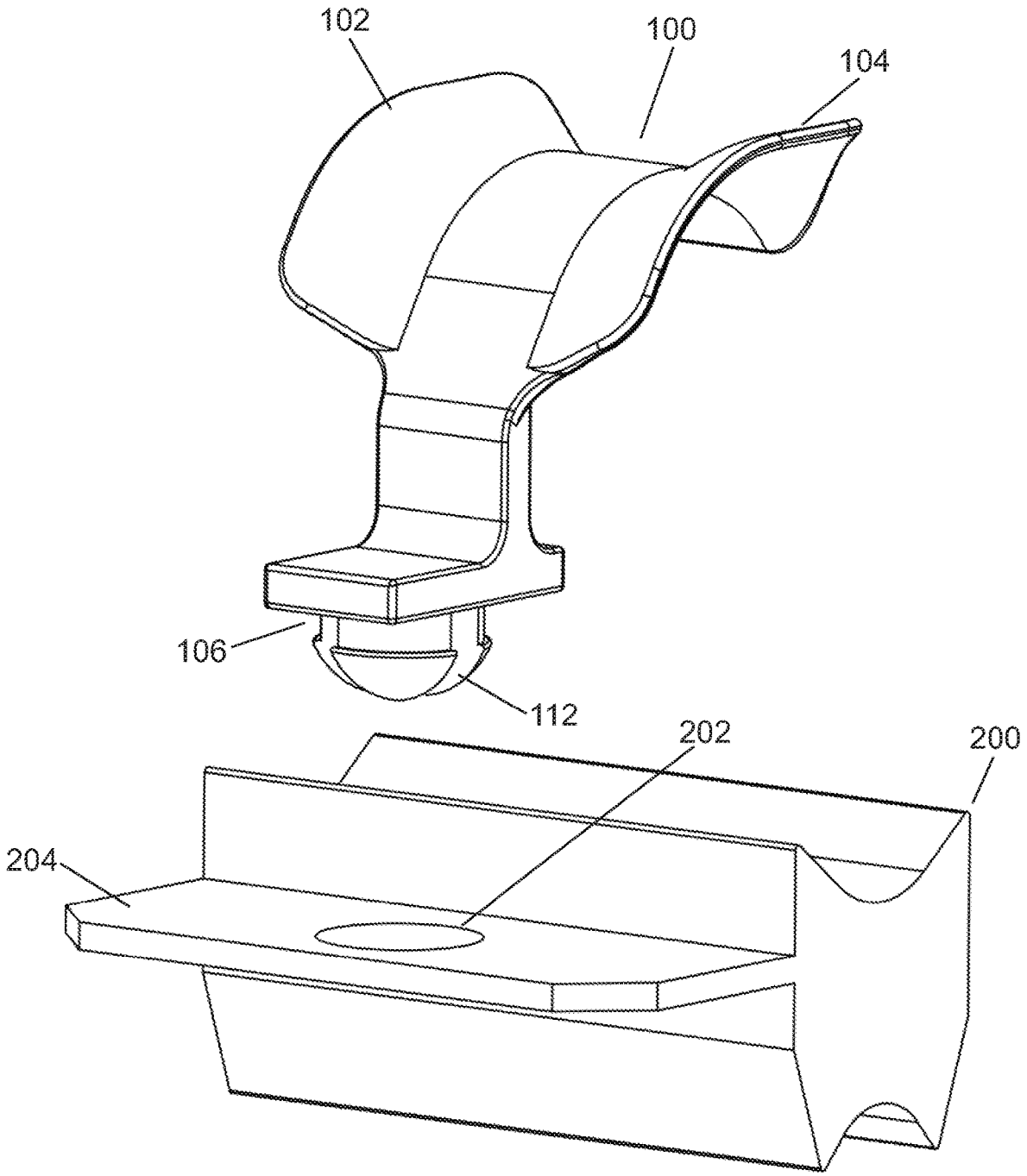
FIG. 1 illustrates a side perspective view of a holding device in accordance with the principles disclosed herein.

Referring initially to FIG. 1, shown is holding device 100 in accordance with the principles disclosed herein. Holding device 100 comprises first flared end 102, second flared end 104, and locking connector 106. First flared end 102 and second flared end 104 are configured to assist in pushing and sliding holding device 100 over a C-Frame (not shown). Further, in some embodiments, holding device 100 is composed of a hard plastic, such that the holding device 100 can withstand the temperatures of the electrical connection while remaining sufficiently flexible to deform and allow the holding device 100 to slide over top of the C-Frame (not shown) and hold interface 200 in place. It would be apparent to one of ordinary skill to utilize other materials, including but not limited to one or more soft plastics, high durometer rubber, or one or more soft metals, without departing from the principles disclosed herein. Locking connector 106 comprises expansion lock 112 and is configured to couple holding device 100 to interface 200. Expansion lock 112 is composed of an elastic material that contracts when expansion lock 112 is inserted into an aperture with a radius less than the radius of expansion lock 112. As shown in FIG. 1, interface 200 comprises hot stick aperture 202. Hot stick aperture 202 is positioned on lip 204 of interface 200. Hot stick aperture 202 comprises a circular shape. It would be apparent to one of ordinary skill to utilize other shapes or sizes for the hot stick aperture without departing from the principles disclosed herein. As explained further below, the hot stick aperture is used to couple the holding device to the interface.

Figure 2:
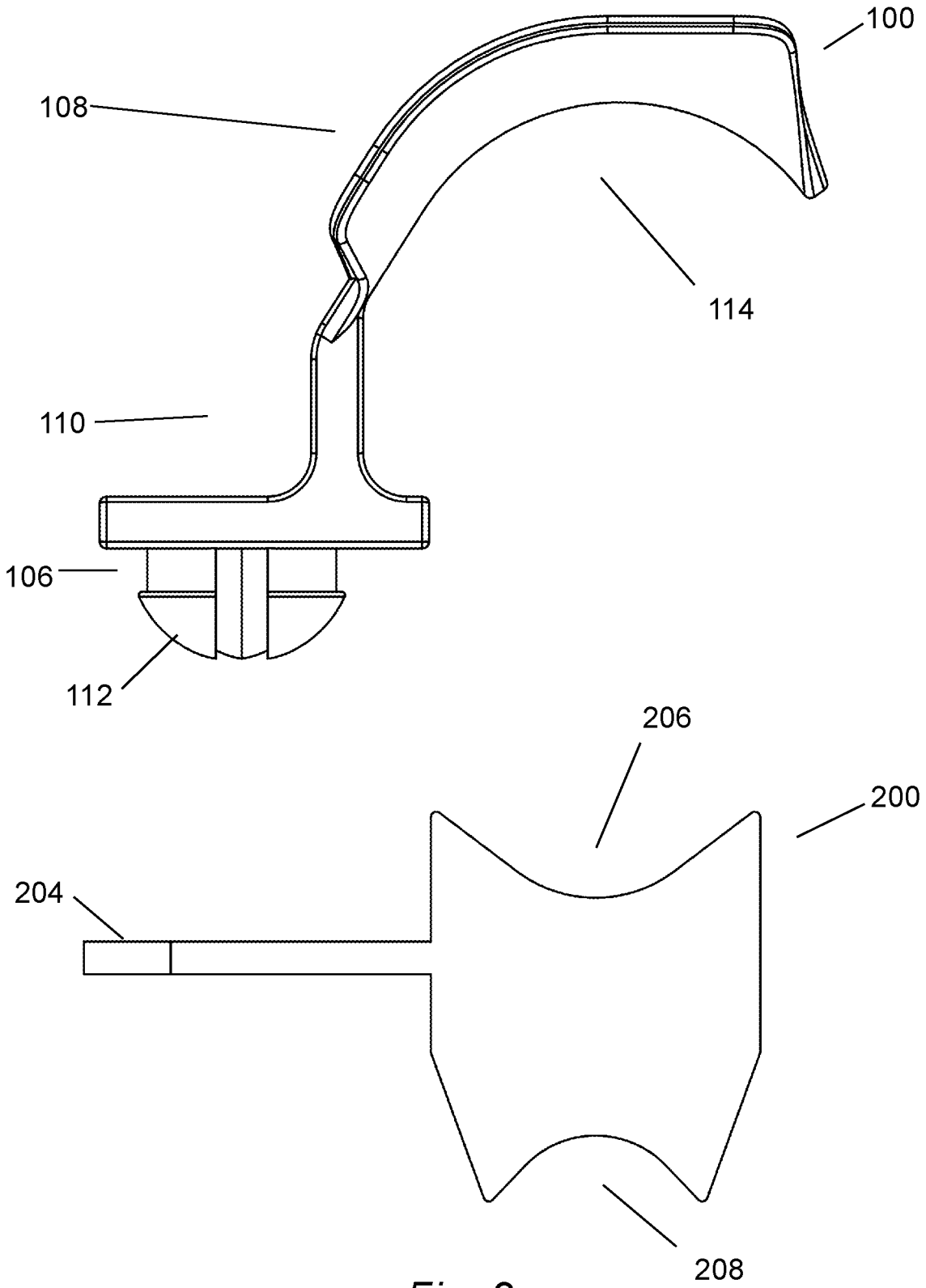
FIG. 2 illustrates a front view of a holding device in accordance with the principles disclosed herein.

FIG. 2 depicts a front view of holding device 100 and interface 200. As shown, interface 106 comprises upper portion 108 and lower portion 110. Upper portion 108 comprises a substantially bowed shape forming channel 114. The substantially bowed shape of upper portion 108 is configured to slide onto and over a C-Frame (not shown). Further, interface 200 comprises a bowed shape or channel 206 that is configured to mate with the cable run. Interface 200 also comprises a bowed shape or channel 208 that is configured to mate with the cable tap. Lower portion 110 is configured to rest on lip 204 of interface 200. While lip 204 is shown as substantially flat shaped, it would be apparent to one of ordinary skill in the art to utilize a lip with a different shape without departing from the principles disclosed herein.

Figure 3:
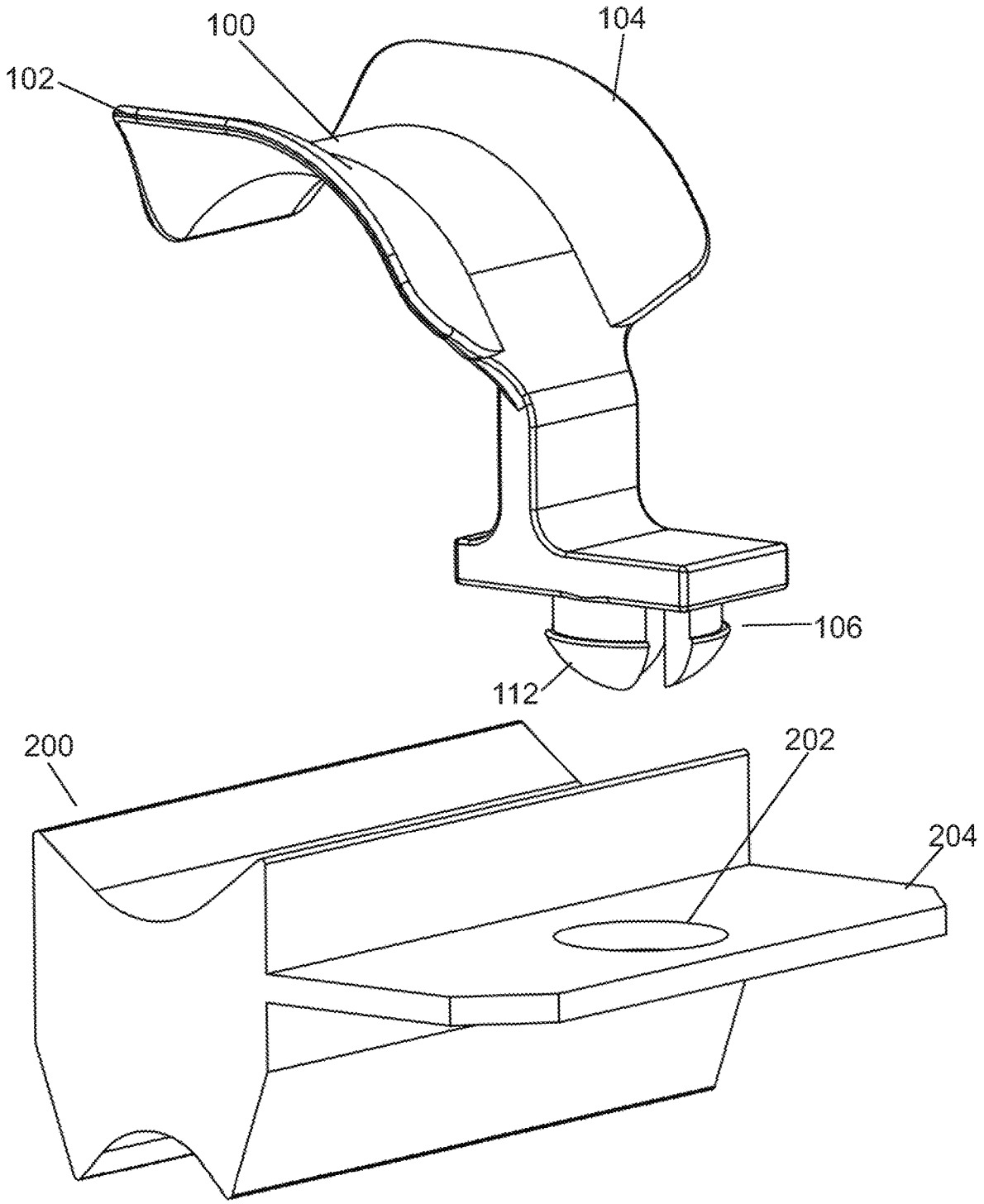
FIG. 3 illustrates a rear perspective view of a holding device in accordance with the principles disclosed herein.

Turning next to FIG. 3, shown is a rear perspective view of holding device 100 in accordance with the principles disclosed herein. Holding device 100 comprises first flared end 102, second flared end 104, and locking connector 106. First flared end 102 and second flared end 104 are configured to assist in pushing and sliding holding device 100 over a C-Frame (not shown). Locking connector 106 comprises expansion lock 112 and is configured to couple holding device 100 to interface 200. Interface 200 comprises hot stick aperture 202 and lip 204.

Figure 4:
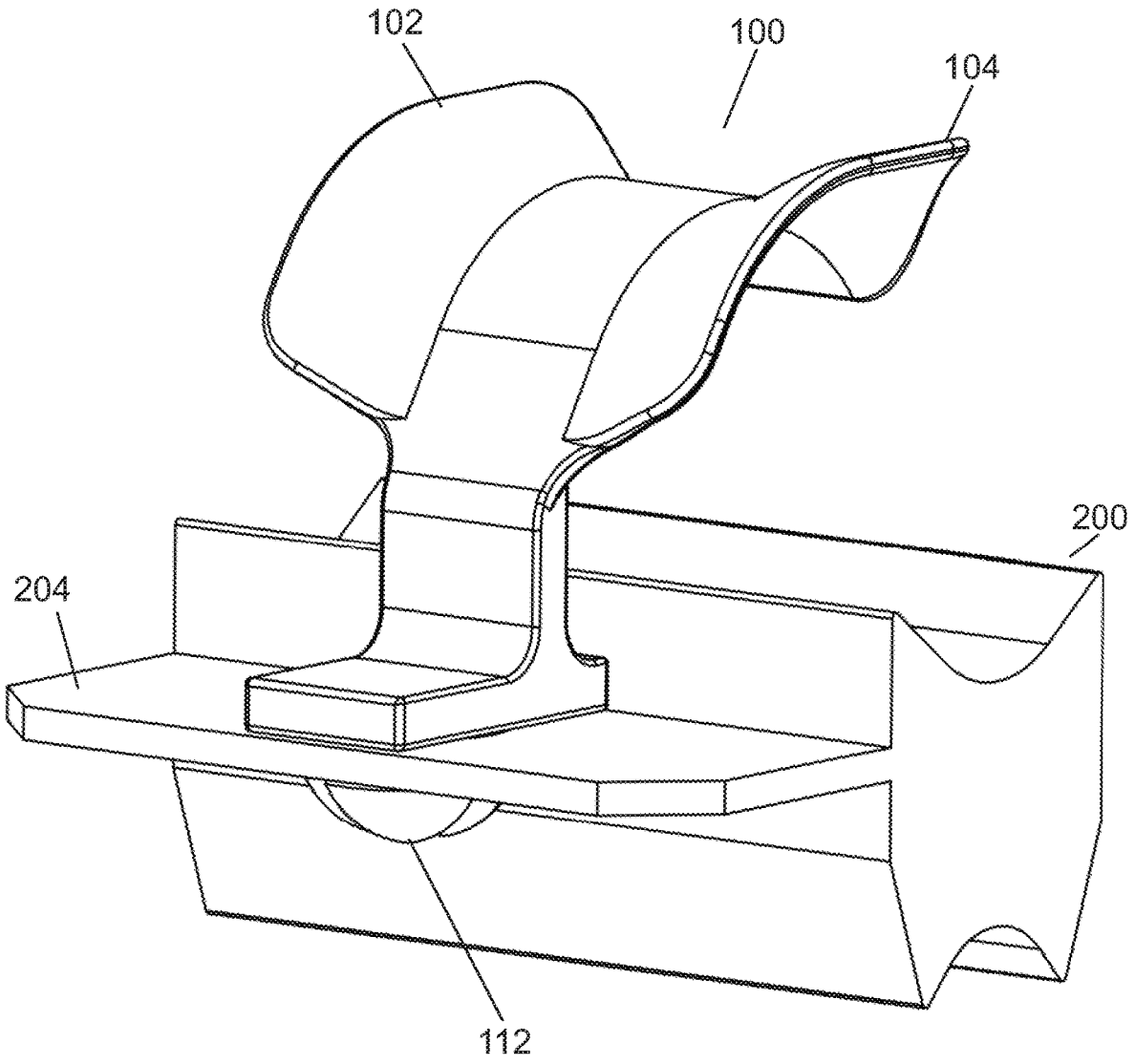
FIG. 4 illustrates a side perspective view of a holding device coupled to an interface in accordance with the principles disclosed herein.

In FIG. 4, holding device 100 is shown coupled to interface 200. Interface 200 comprises hot stick aperture (not shown) and lip 204. Expansion lock 112 of holding device 100 is shown fully inserted into hot stick aperture (not shown). The system of coupling the holding device 100 to the interface 200 through inserting expansion lock 112 into a hot stick aperture (not shown) is referenced for exemplary purposes only. It would be readily apparent to one of ordinary skill in the art to utilize other systems of coupling holding device 100 to interface 200 without departing from the principles disclosed herein. Other systems of coupling holding device 100 to the interface 200 include, but are not limited to, a locking system utilizing a channel that the locking connector is configured to removably couple to, a rivet system utilizing rivets to removably couple holding device 100 to interface 200, or a snapping button system utilizing a snap button and receiving connector.

Figure 5:
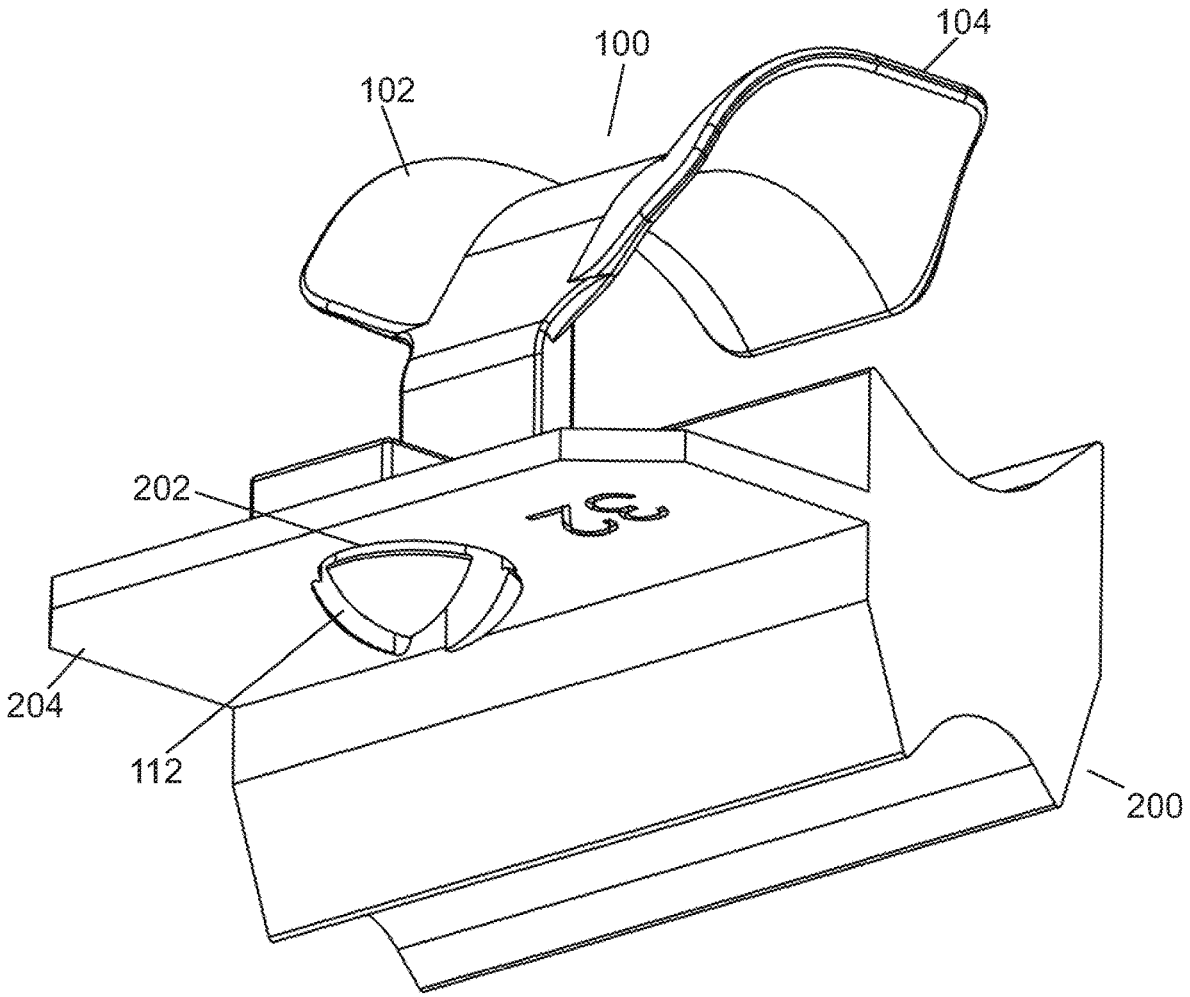
FIG. 5 illustrates a bottom perspective view of a holding device coupled to an interface in accordance with the principles disclosed herein.

Shown in FIG. 5 is a bottom perspective view of holding device 100 coupled to interface 200. Holding device 100 comprises first flared end 102 and second flared end 104. Interface 200 comprises hot stick aperture 202 and lip 204. As shown, the radius of expansion lock 112 is greater than the radius of hot stick aperture 202. Therefore, holding device 100 is secured to interface 200. Further, the split design of expansion lock 112 allows holding device 100 to be unsecured from interface 200 by compressing expansion lock 112 and applying a sufficient force to push the compressed expansion lock 112 out of hot stick aperture 202.

Figure 6:
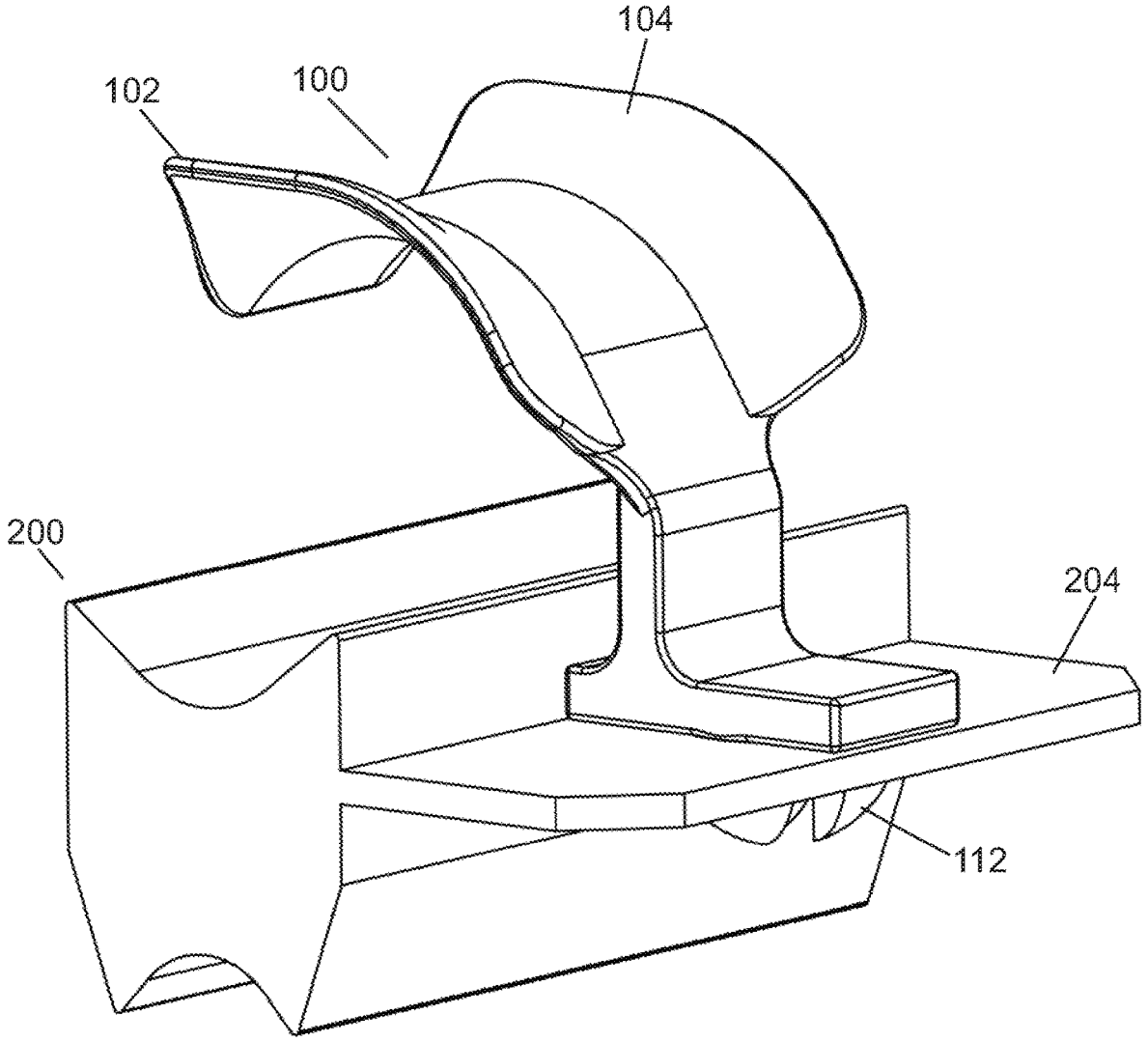
FIG. 6 illustrates a rear perspective view of a holding device coupled to an interface in accordance with the principles disclosed herein.

FIG. 6 shows a side perspective view of locking connector 106 fully inserted into hot stick aperture 202. The process of coupling holding device 100 to interface 200 begins with expansion lock 112 being pressed against hot stick aperture 202. Expansion lock 112 is configured to elastically contract as it enters hot stick aperture 202. After expansion lock 112 passes through aperture 202, it returns to substantially its original shape as shown in FIG. 6, thereby securing holding device 100 to interface 200. It would be apparent to one of ordinary skill in the art to utilize various methods to couple the holding device to the interface without departing from the principles disclosed herein. For example, the interface can include a channel that the locking connector is configured to removably couple to.

Figure 7:
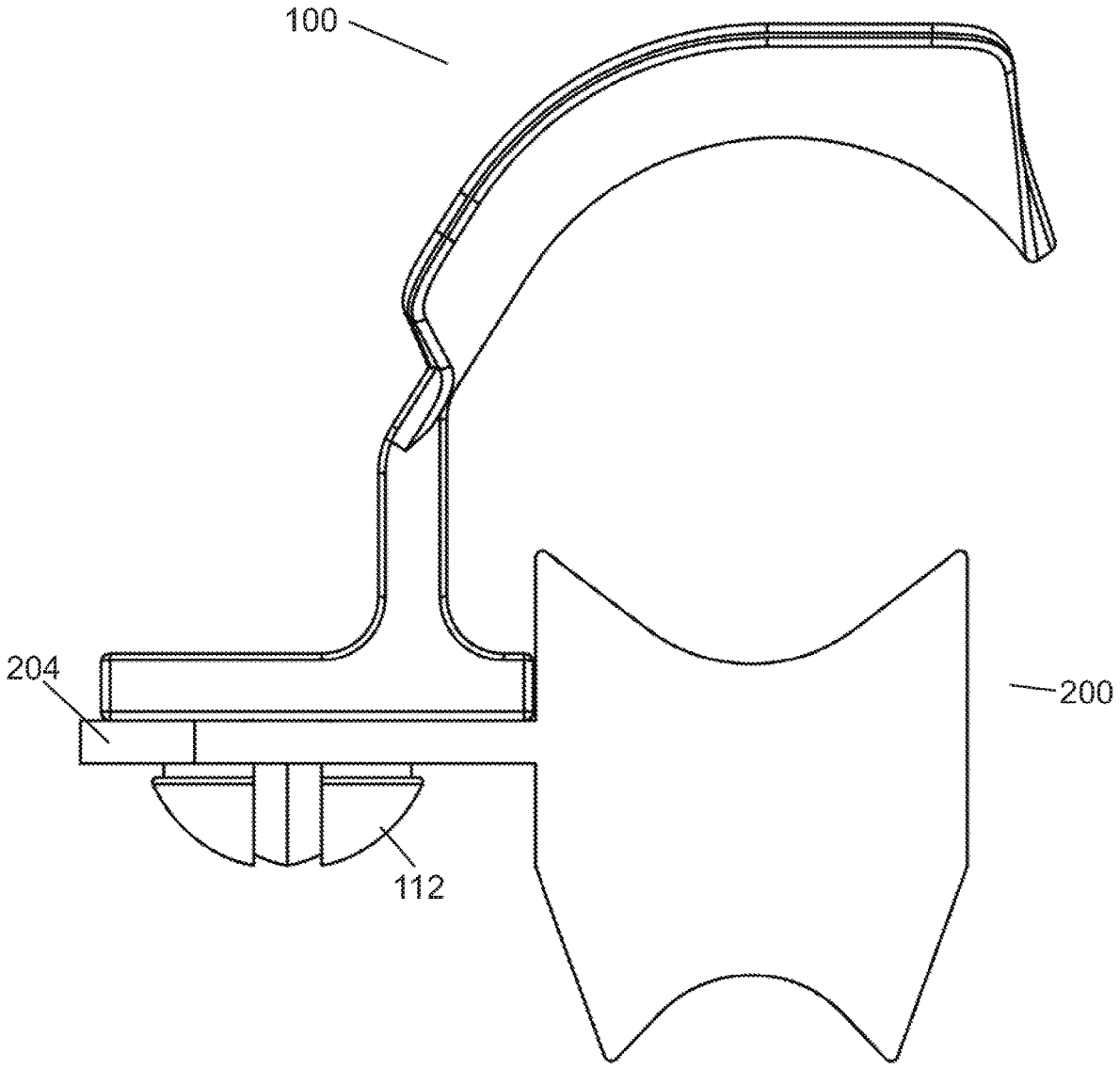
FIG. 7 illustrates a front view of a holding device coupled to an interface in accordance with the principles disclosed herein.

Shown in FIG. 7 is a front view of holding device 100 coupled to interface 200. Holding device 100 is configured to rest on lip 204 of interface 200 when expansion lock 112 is fully inserted into a hot stick aperture (not shown). As shown, expansion lock 112 has returned to substantially its original shape after being inserted through the aperture. Expansion lock 112 comprises a circular shape. The radius of expansion lock 112 is greater than the radius of the aperture that it was inserted through, thereby securing holding device 100 to interface 200. It would be apparent to one of ordinary skill to utilize other shapes and sizes for the expansion lock without departing from the principles disclosed herein.

Figure 8:
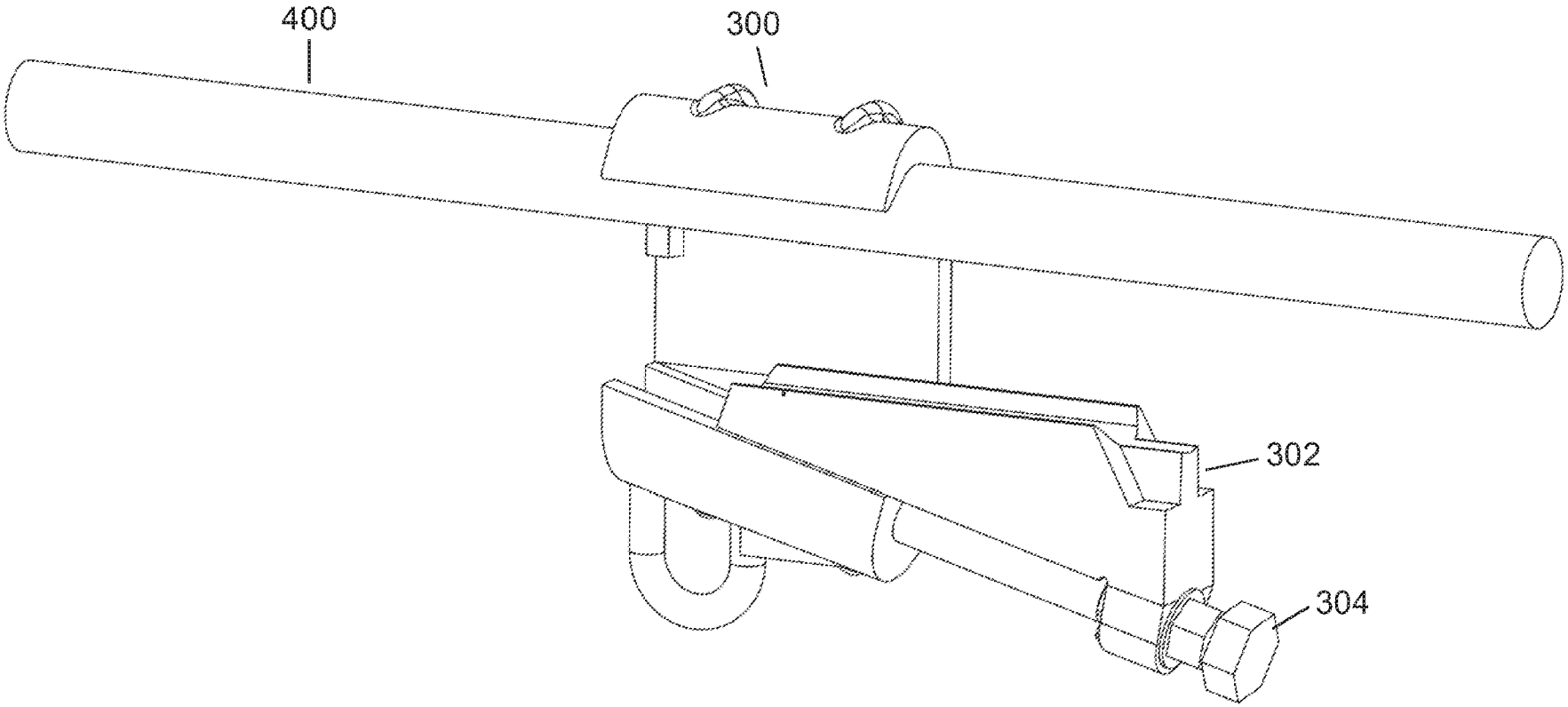
FIG. 8 illustrates a step in a process of coupling a cable tap to a cable run in accordance with the principles disclosed herein.

Referring to FIGS. 8-12, shown is the process of utilizing a holding device in accordance with the principles disclosed herein for connecting a cable tap to a main cable run. Initially as shown in FIG. 8, C-Frame 300 is loosely coupled to cable run 400. C-Frame 300 comprises wedge 302 and screw 304. Screw 304 is depicted in an open position, thereby allowing components to be positioned between wedge 302 and cable run 400. At this stage of the installation process, the field operator may be required to hold loose components.

Figure 9:
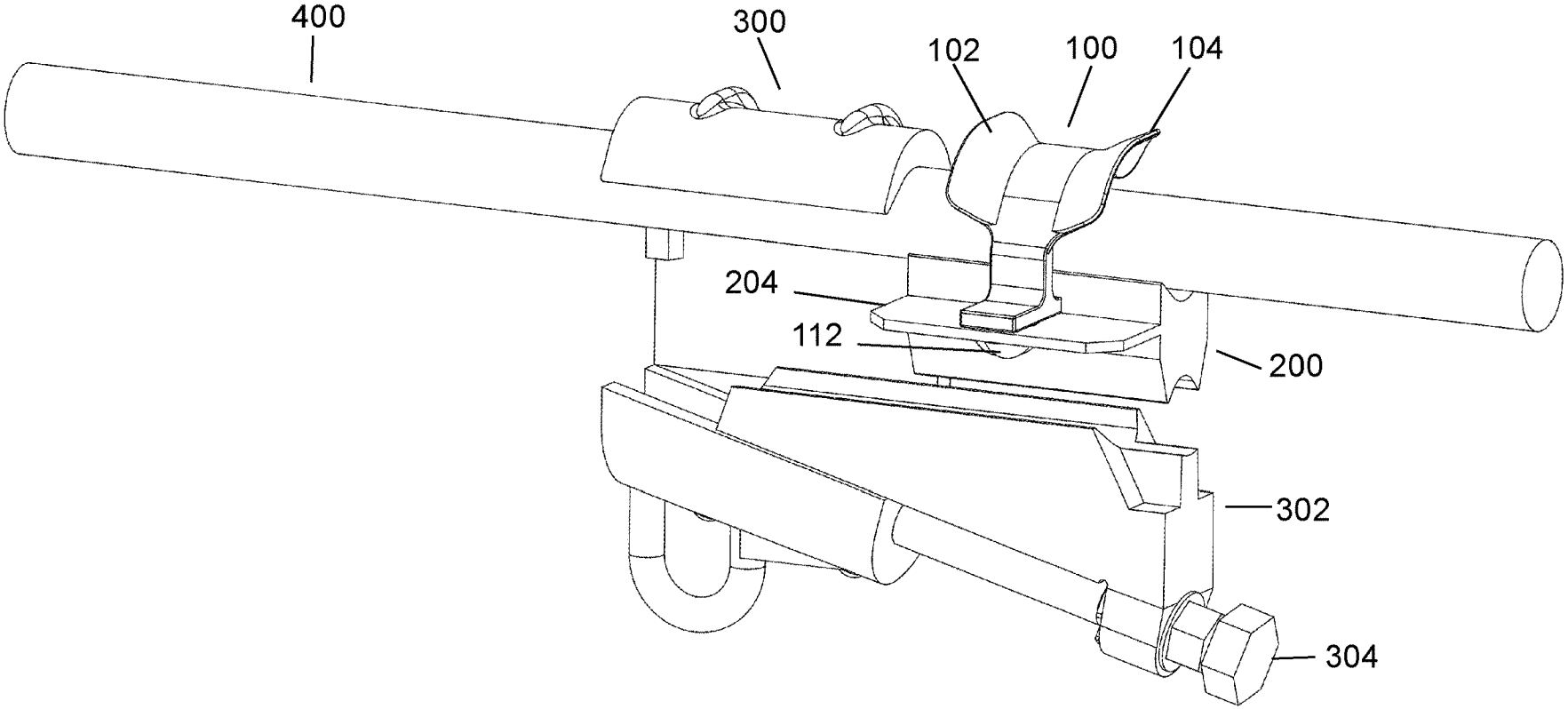
FIG. 9 illustrates a step in a process of coupling a cable tap to a cable run in accordance with the principles disclosed herein.

Next, as shown in FIG. 9, holding device 100 is coupled to interface 200. Holding device 100 comprises first flared end 102 and second flared end 104. Interface 200 comprises hot stick aperture (not shown) and lip 204. The process of coupling holding device 100 to interface 200 begins with expansion lock 112 being pressed against the hot stick aperture of interface 200 (not shown). Expansion lock 112 is configured to elastically contract as it enters the hot stick aperture (not shown). After expansion lock 112 passes through the hot stick aperture (not shown), it returns to substantially its original shape as shown in FIG. 9, thereby securing holding device 100 to interface 200. Holding device 100 and interface 200 are positioned over a portion of cable run 400 adjacent to C-Frame 300. At this point, C-Frame 300 remains loosely installed over cable run 400 and can become dislodged.

Figure 10:
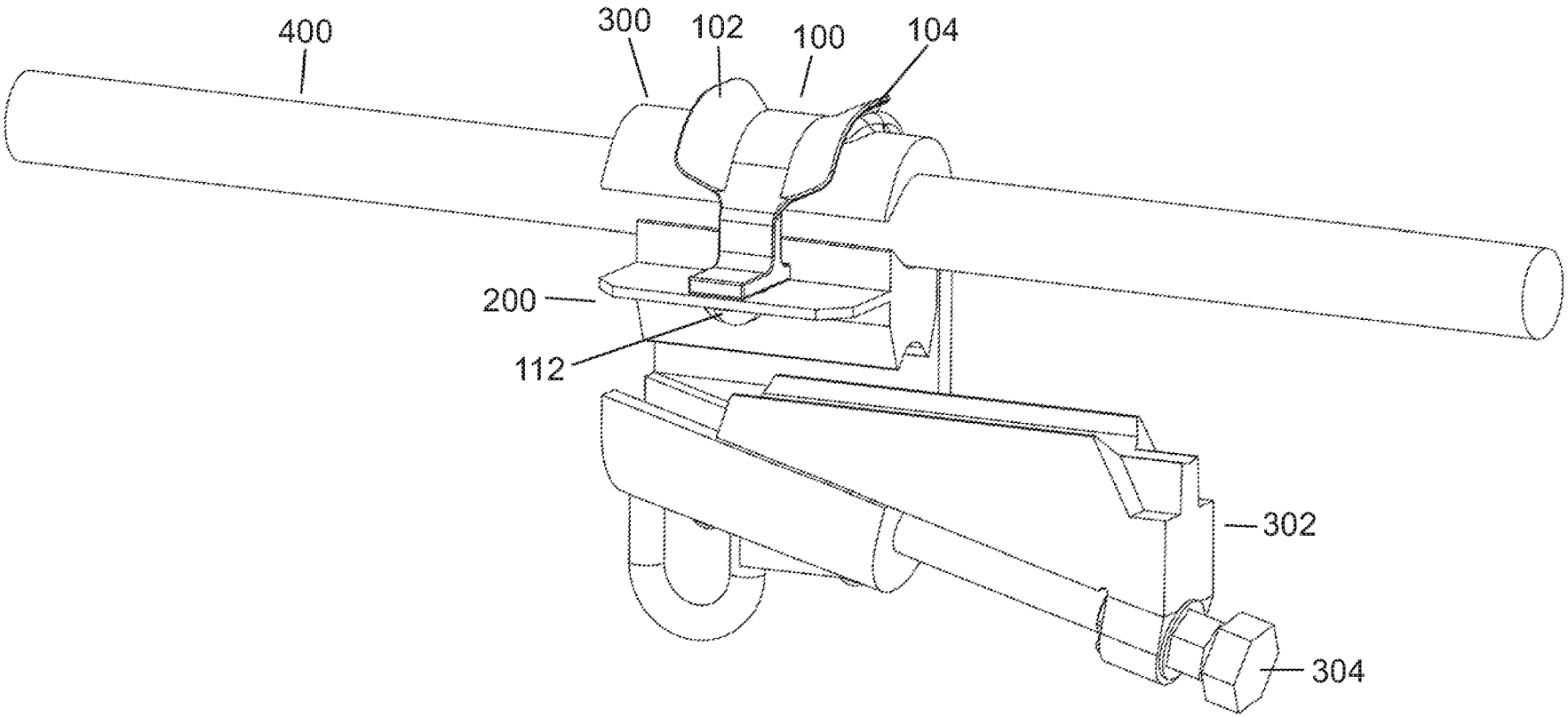
FIG. 10 illustrates a step in a process of coupling a cable tap to a cable run in accordance with the principles disclosed herein.

Turning next to FIG. 10, C-Frame 300 is secured to cable run 400. First flared end 102 of holding device 100 is configured to assist in pushing holding device 100 over and onto C-Frame 300. Similarly, second flared end of holding device 100 is configured to assist in pushing holding device 100 over and onto C-Frame 300. Holding device 100 is secured to interface 200 by expansion lock 112. Expansion lock 112 is inserted into a hot stick aperture (not shown) of interface 200. As a result, the operator's hands are free from the requirement of securing C-Frame 300 to cable run 400 when installing a cable tap.

Figure 11:
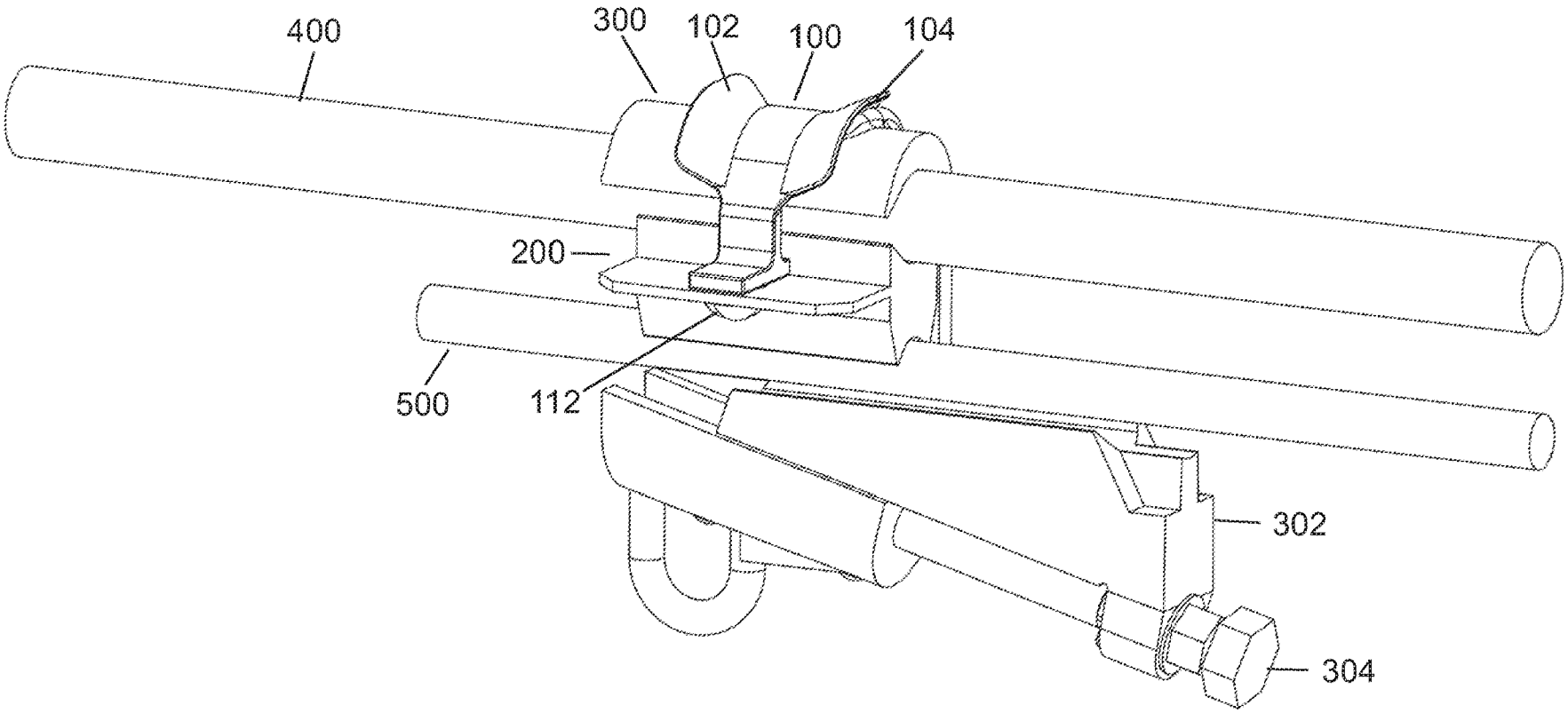
FIG. 11 illustrates a step in a process of coupling a cable tap to a cable run in accordance with the principles disclosed herein.

Referring to FIG. 11, cable tap 500 is positioned between wedge 302 and interface 200. As shown, interface 200 remains secured to C-Frame 300 by holding device 100. Holding device 100 comprises first flared end 102 and second flared end 104. Holding device 100 is secured to interface 200 by expansion lock 112. Expansion lock 112 is inserted into a hot stick aperture (not shown) of interface 200. Thereby, the field operator's hands are free to focus on properly positioning cable tap 500 between wedge 302 and interface 200, without C-Frame 300 or interface 200 dislodging from cable run 400.

Figure 12:
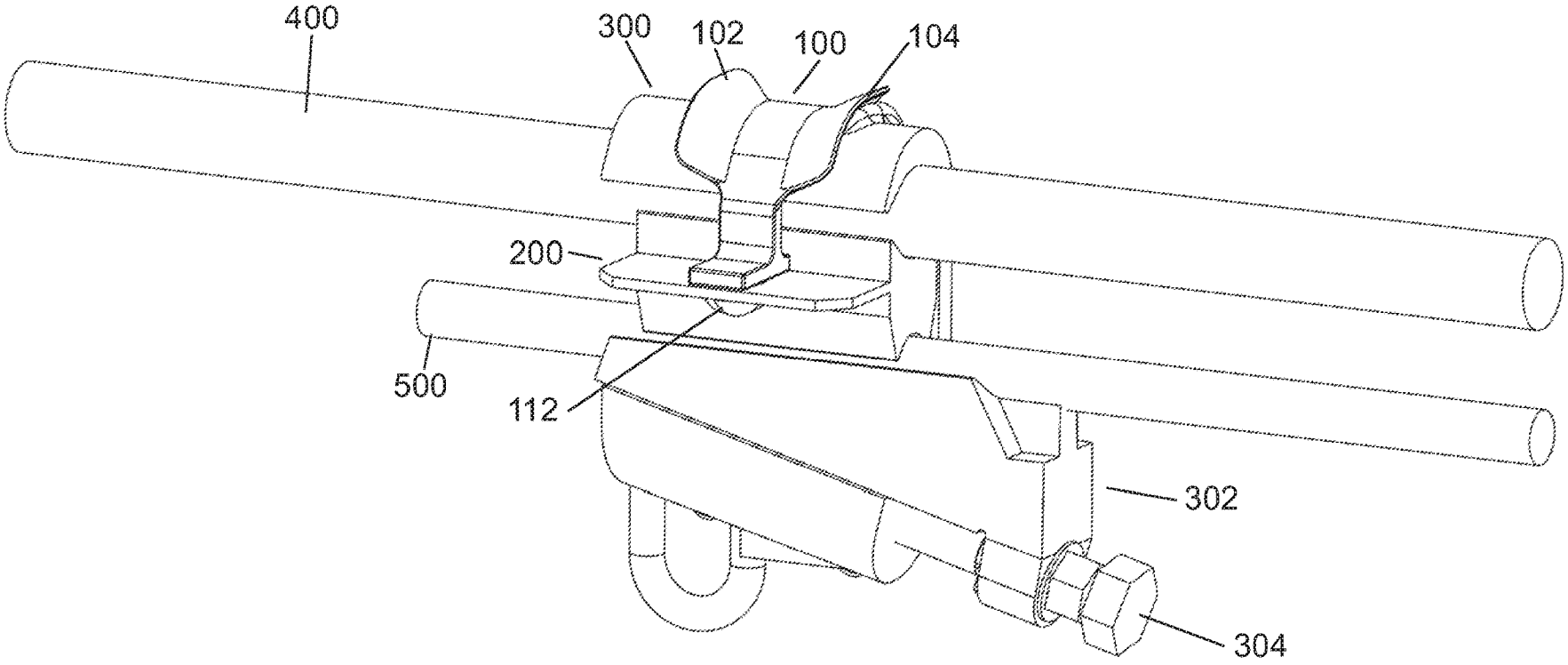
FIG. 12 illustrates a step in a process of coupling a cable tap to a cable run in accordance with the principles disclosed herein.

In FIG. 12, shown is cable tap 500 fully secured between wedge 302 and interface 200. The process begins by tightening screw 304 which advances the position of wedge 302 in a forward direction. As wedge 302 advances in the forward direction it applies an upward and lateral force, thereby securing cable tap 500 to interface 200. The process can be reversed by loosening screw 304. C-Frame 300 and interface 200 remain secured to cable run 400 during the tightening and loosening process of wedge 302, because interface 200 is coupled to holding device 100. Holding device 100 comprises first flared end 102 and second flared end 104. Holding device 100 is secured to interface 200 by expansion lock 112. Expansion lock 112 is inserted into the hot stick aperture (not shown) of interface 200. Further, holding device 100 is coupled to C-Frame 300. C-Frame 300 is coupled to cable run 400. As a result, a field operator's hands are free to adjust the installation of cable tap 500 to interface 200. Holding device 100 can be optionally removed after the operator completes engaging wedge 302. However, because holding device 100 is made of a material that can withstand the temperatures of the electrical connection, holding device 100 may be left on the C-Frame 300 after the operator completes engaging the wedge 302.

The detailed description is not intended to be limiting or represent an exhaustive enumeration of the principles disclosed herein. It will be apparent to those of skill in the art that numerous changes may be made in such details without departing from the spirit of the principles disclosed herein.

What is claimed is:

1. A connection device, comprising:
a holding device comprising:
an upper portion comprising a first substantially concave channel, and
a lower portion coupled to the upper portion, the lower portion comprising a connector;
an interface comprising:
a body comprising:
a second substantially concave channel,
a third substantially concave channel, and
a lip extending outward from the body;
wherein the lip is configured to be coupled to the connector.

2. The connection device of claim 1, wherein the connector comprises an expansion lock.

3. The connection device of claim 2, wherein the lip comprises a hot stick aperture configured to receive the expansion lock.

4. The connection device of claim 2, wherein the expansion lock comprises an elastic material.

5. The connection device of claim 2,
wherein the lip comprises a hot stick aperture; and
wherein the expansion lock is configured to removably couple with the hot stick aperture.

6. The connection device of claim 1, wherein the lip comprises a fourth channel configured to receive and secure the connector.

7. The connection device of claim 1, wherein the connector and the lip comprise a rivet system configured to removably couple the holding device to the interface.

8. The connection device of claim 1, wherein the holding device consists of hard plastic.

9. The connection device of claim 1, wherein the holding device comprises one or more soft plastics, high durometer rubber, or one or more soft metals.

10. The connection device of claim 1, wherein the holding device comprises a first flared end and a second flared end.

11. The connection device of claim 10, wherein the first flared end and the second flared end are flared away from the substantially concave surface.

12. A method of attaching a cable tap to a cable run, comprising:
positioning a holding device to hang on a cable run;
coupling an interface to the holding device;
positioning the holding device at least partially on top of a C-frame of a separate wedge connector to secure the C-frame to the cable run; and
coupling a cable tap to the interface and the wedge connector.

13. The method of claim 12, wherein coupling the holding device to the interface comprises pressing an expansion lock on the holding device against a hot stick aperture on the interface.

14. The method of claim 12, wherein coupling the holding device to the interface comprises snapping a button and a receiving connector together.

15. The method of claim 12, comprising:
sliding the holding device at least partially over the C-frame of the wedge connector.

16. The method of claim 12, comprising:
tightening a screw on the wedge connector to secure the cable tap to the wedge connector.

17. The connection device of claim 1, wherein the holding device and the interface are configured so that when the lip is coupled to the connector, the first substantially concave surface and the second substantially concave surface at least partially encircle a common area.

* * * * *